US009972923B2

(12) United States Patent
Kitatani

(10) Patent No.: US 9,972,923 B2
(45) Date of Patent: May 15, 2018

(54) TERMINAL BLOCK WITH A TERMINAL COVER

(71) Applicant: TDK Corporation, Minato-ku, Tokyo (JP)

(72) Inventor: Kazuharu Kitatani, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days. days.

(21) Appl. No.: 15/680,826

(22) Filed: Aug. 18, 2017

(65) Prior Publication Data

US 2018/0062283 A1 Mar. 1, 2018

(30) Foreign Application Priority Data

Aug. 31, 2016 (JP) ..... 2016-169125

(51) Int. Cl.

| | |
|---|---|
| ***H01R 9/22*** | (2006.01) |
| ***H01R 9/24*** | (2006.01) |
| ***H01R 9/18*** | (2006.01) |
| *H01R 4/34* | (2006.01) |

(52) U.S. Cl.

CPC ..... *H01R 9/223* (2013.01); *H01R 9/18* (2013.01); *H01R 9/2416* (2013.01); *H01R 4/34* (2013.01)

(58) Field of Classification Search

CPC ..... H01R 9/223; H01R 9/18; H01R 9/2416; H01R 4/34; H01R 9/24

USPC ..... 439/709, 718, 948

See application file for complete search history.

(56) References Cited

U.S. PATENT DOCUMENTS

| | | | | |
|---|---|---|---|---|
| 3,157,453 A * | 11/1964 | Lanczi | H01R 9/26 | 439/716 |
| 4,050,770 A * | 9/1977 | Rigo | H01R 9/24 | 174/59 |
| 4,180,305 A * | 12/1979 | Ustin | H01R 9/2408 | 439/717 |
| 6,497,592 B1 * | 12/2002 | Beadle | H01R 9/2425 | 439/718 |
| 6,630,626 B2 * | 10/2003 | Johnson | H01H 85/0208 | 174/138 F |
| 6,963,780 B2 * | 11/2005 | Ruben | A61N 1/3754 | 439/626 |

FOREIGN PATENT DOCUMENTS

| | | |
|---|---|---|
| JP | 60-168271 U | 11/1985 |
| JP | 2000-113918 A | 4/2000 |
| JP | 2002-50419 A | 2/2002 |

* cited by examiner

*Primary Examiner* — Tulsidas C Patel
*Assistant Examiner* — Travis Chambers
(74) *Attorney, Agent, or Firm* — Flynn, Thiel, Boutell & Tanis, P.C.

(57) ABSTRACT

There is provided a terminal block to which load lines can be attached in multiple directions and which includes a terminal cover that makes terminal portions difficult for fingers to touch and is less likely to damage the load lines. The terminal block includes: a conductive plate including a first-direction connection portion that extends in a first direction and is capable of being connected with at least one wire, and a second-direction connection portion that is in electrical conduction with the first-direction connection portion, extends in a second direction different from the first direction, and is capable of being connected with at least one wire.

20 Claims, 9 Drawing Sheets

TERMINAL BLOCK WITH A TERMINAL COVER

BACKGROUND OF THE INVENTION

1. Field of the Invention

The present invention relates to a terminal block used for connecting inputs and outputs of electronic equipment.

2. Description of the Related Art

Terminal blocks for connecting inputs and outputs have conventionally been attached to electronic equipment such as a power supply apparatus. FIG. 9A shows a conventional terminal block 101. The terminal block 101 has a structure in which side walls 290 are erected on a base block made of an insulating material, and a plurality of terminal portions 310 are arranged between the side walls 290. In the structure, as shown in FIG. 9B, a plate-like terminal cover 300 further covers the tops of the terminals to prevent fingers and conductive parts from accidentally touching the terminal portions 310 or screws 100 (for example, see Japanese Patent Application Laid-Open No. 2000-113918.

Another terminal block having a structure capable of selectively attaching load lines (wires) in different directions has also been proposed (see Japanese Patent Application Laid-Open No. 2002-50419. Specifically, in a terminal block 102 shown in FIG. 9C, a load line 260 extending in a Z-axis direction, or first direction, can be fastened to a terminal portion 310 with a screw 100. A load line 270 extending in a Y-axis direction, or second direction, can be fastened to a terminal portion 310 with a screw 100. Such a terminal block having the structure capable of attaching load lines in multiple directions also needs to prevent fingers from accidentally touching the terminal portions 310 or the screws 100. For example, Japanese Utility Model Application Laid-Open No. Sho. 60-168271proposes a technique for directly attaching a cover to terminal portions to which no load line is connected, by using female screw holes of the respective terminal portions.

As shown in FIG. 9C, if load lines can be attached to a terminal block in multiple directions, fingers, conductive parts, and the like may accidentally touch the terminal portions to which no load line is attached. If a plate-like terminal cover like the one shown in FIG. 9B is used for such terminal portions, the load lines can come into contact with the terminal cover, and the terminal cover can be damaged or come off. The terminal cover can also be in contact with the load lines or the like to damage the cladding and the like of the load lines.

If the technique described in Patent Literature 3 is used, insertion pins provided on the terminal cover have a top end of arrowhead shape. Once the insertion pins are inserted into the female holes in the terminal portions of the terminal block, the terminal cover is difficult to detach due to the barbs of the arrowheads.

SUMMARY OF THE INVENTION

The present invention has been made in view of the aforementioned problems. It is an object of the invention to provide a terminal block to which load lines can be attached in multiple directions and which includes a terminal cover that makes terminal portions difficult for fingers to touch and is less likely to damage the load lines.

(1) The present invention provides a terminal block including: a conductive plate including a first-direction connection portion configured to extend in a first direction and to be capable of being connected with at least one wire, and a second-direction connection portion configured to be in electrical conduction with the first-direction connection portion, to extend in a second direction different from the first direction, and to be capable of being connected with at least one wire; a terminal block main body portion including a side wall arranged on an outer side of the conductive plate in a width direction; a terminal cover configured to cover a surface of any one of the first-direction connection portion and the second-direction connection portion; a first engagement portion configured to be formed on the terminal block main body portion and to hold the terminal cover in a position in which the terminal cover covers the first-direction connection portion; and a second engagement portion configured to be formed on the terminal block main body portion and to hold the terminal cover in a positon in which the terminal cover covers the second-direction connection portion.

According to the invention set forth in the foregoing (1), there is provided an excellent effect that a safe terminal block to which load lines can be attached in a plurality of directions including the first direction and the second direction and in which a terminal cover can be attached to a connection portion of either direction so that fingers are less likely to touch terminal portions can be provided.

(2) The present invention provides the terminal block set forth in the foregoing (1), wherein the terminal cover includes a proximity surface that comes close to or in contact with a surface of the first-direction connection portion or the second-direction connection portion, and a receding surface that is continuously formed from the proximity surface and recedes from the first-direction connection portion or the second-direction connection portion.

According to the invention set forth in the foregoing (2), even if there is an erected portion vertically erected from a connection portion in the middle of the connection portion, the erected portion can be circumvented by the receding surface. This produces an excellent effect that there can be provided a terminal block including a terminal cover that is integral as a whole and can cover the connection portion.

(3) The present invention provides the terminal block set forth in the foregoing (2), wherein the conductive plate comprises a plurality of conductive plates disposed in parallel in the width direction, the side wall is interposed between the plurality of conductive plates so that the side wall serves as a separator, and in the terminal cover, the receding surface comprises a pair of receding surfaces forming a recessed portion, the recessed portion being formed to circumvent a part of the separator.

According to the invention set forth in the foregoing (3), if the connection portions are divided into a plurality of sections by the separator, a terminal cover shaped to circumvent the separator can be provided. This produces an excellent effect that a terminal block including a terminal cover capable of integrally covering the connection portions divided in the plurality of sections can be provided.

(4) The present invention provides the terminal block set forth in any one of the foregoing (1) to (3), wherein the conductive plate comprises a plurality of conductive plates disposed in parallel in the width direction, the side wall is interposed between the plurality of conductive plates so that the side wall serves as a separator, and the terminal cover includes a curved portion curved to circumvent the separator.

According to the invention set forth in the foregoing (4), the terminal cover includes the curved portion. If the connection portions are divided into a plurality of sections by the separator, a terminal cover shaped to circumvent the separator can thus be provided. This produces an excellent effect that a terminal block including a terminal cover capable of integrally covering the connection portions divided in the plurality of sections can be provided.

(5) The present invention provides the terminal block set forth in the foregoing (4), wherein the curved portion includes a protrusion configured to be engageable with a finger.

According to the invention set forth in the foregoing (5), the curved portion formed on the terminal cover includes a finger hook protrusion to be engaged with a finger. The user can thus hold the terminal cover with a finger engaged with the protrusion. The terminal cover can thus be held in a mode such that terminal portions are less likely to be touched with fingers in attaching or detaching the terminal cover.

(6) The present invention provides the terminal block set forth in the foregoing (4) or (5), wherein the curved portion includes an elastically-deformable bending portion.

According to the invention set forth in the foregoing (6), the curved portion of the terminal cover includes the bending portion which can be pinched and elastically deformed between fingers. The curved portion of the terminal cover can thus be pinched and elastically deformed between fingers. This produces an excellent effect that the terminal cover can be easily detached from and attached to the engagement portions for engaging the terminal cover with the terminal block.

(7) The present invention provides the terminal block set forth in any one of the foregoing (4) to (6), wherein a gap is formed between the curved portion and the separator, and the gap increases toward the first-direction connection portion or the second-direction connection portion.

According to the invention set forth in the foregoing (7), the gap formed between the separator and the terminal cover increases toward a connection portion. The closer the curved portion provided on the terminal cover is to the connection portion, the more largely the terminal cover moves. This provides an excellent effect that the terminal cover can be easily detached from and attached to the engagement portions configured to engage the terminal cover with the terminal block.

(8) The present invention provides the terminal block set forth in any one of the foregoing (1) to (7), wherein the terminal cover includes a connection side terminal cover configured to cover any one of the first-direction connection portion and the second-direction connection portion to which a wire is connected, and a non-connection side terminal cover configured to cover the other of the first-direction connection portion and the second-direction connection portion to which no wire is connected, and a distance between the connection side terminal cover and the one connection portion is greater than that between the non-connection side terminal cover and the other connection portion.

According to the invention set forth in the foregoing (8), the distance between the connection portion to which no load line is connected and the non-connection side terminal cover that covers the connection portion to which no load line is connected is made narrow. This can reduce the possibility that fingers accidentally touch the non-connection side connection portion through between the connection side terminal cover and the non-connection side terminal cover. There is provided an excellent effect that safety improves significantly.

(9) The present invention provides the terminal block set forth in any one of the foregoing (1) to (7), wherein the terminal cover includes a connection side terminal cover configured to cover any one of the first-direction connection portion and the second-direction connection portion to which a wire is connected, and a non-connection side terminal cover configured to cover the other of the first-direction connection portion and the second-direction connection portion to which no wire is connected, and the non-connection side terminal cover is set to a dimension not interfering with a virtually extended plane of a wiring placement surface of the one connection portion.

According to the invention set forth in the foregoing (9), the non-connection side terminal cover configured to cover the connection portion to which no load line is connected does not interfere with the virtually extended plane of the wiring placement surface of the one connection portion. This provides an effect of reducing the possibility that the non-connection side terminal cover damages the cladding of the load line.

(10) The present invention provides the terminal block set forth in the foregoing (9), wherein the connection side terminal cover is set to a dimension interfering with a virtually extended plane of a wiring placement surface of the other connection portion.

According to the invention set forth in the foregoing (10), the connection side terminal cover is set to the dimension interfering with the virtually extended plane of the wiring placement surface of the other connection portion. The connection side terminal cover thus provides a structure covering the gap between the non-connection side terminal cover and the connection portion. This produces an excellent effect of reducing the possibility that fingers accidentally touch the non-connection side connection portion.

(11) The present invention provides the terminal block set forth in any one of the foregoing (1) to (10), wherein the first engagement portion includes a first side non-connection engagement portion for the non-connection side terminal cover to be engaged with and a first side connection engagement portion for the connection side terminal cover to be engaged with, the second engagement portion includes a second side non-connection engagement portion for the non-connection side terminal cover to be engaged with and a second side connection engagement portion for the connection side terminal cover to be engaged with, the first side non-connection engagement portion and the second side non-connection engagement portion have substantially the same shapes, and the first side connection engagement portion and the second side connection engagement portion have substantially the same shapes.

According to the invention set forth in the foregoing (11), the non-connection side terminal cover and the connection side terminal cover can be used for the plurality of connection portions included in the terminal block in common. This provides an effect that the number of terminal covers to be prepared in advance can be reduced to reduce costs.

(12) The present invention provides the terminal block set forth in the foregoing (11), wherein a common shape of the first side non-connection engagement portion and the second side non-connection engagement portion is different from a common shape of the first side connection engagement portion and the second side connection engagement portion.

According to the invention set forth in the foregoing (12), the engagement portions for the non-connection side terminal cover to be engaged with and the engagement portions for the connection side terminal cover to be engaged with have different shapes. This can eliminate the possibility that the non-connection side terminal cover is accidentally engaged with the engagement portions for the connection side terminal cover. There is provided an effect that a gap enough for a finger to enter becomes less likely to occur and safety improves.

(13) The present invention provides the terminal block set forth in any one of the foregoing (1) to (12), wherein the first direction and the second direction are substantially perpendicular.

According to the invention set forth in the foregoing (13), the first direction and the second direction are substantially perpendicular. This produces an effect of providing a terminal block to which load lines can be connected in two mutually-perpendicular directions.

According to the present invention, there is provided an excellent effect that a safe terminal block to which load lines can be attached in the plurality of directions including the first and second directions and to which a terminal cover can be attached to the connection portion of either direction so that fingers are less likely to touch the terminal portions can be provided.

DETAILED DESCRIPTION OF THE PREFERRED EMBODIMENTS

Figure 1:
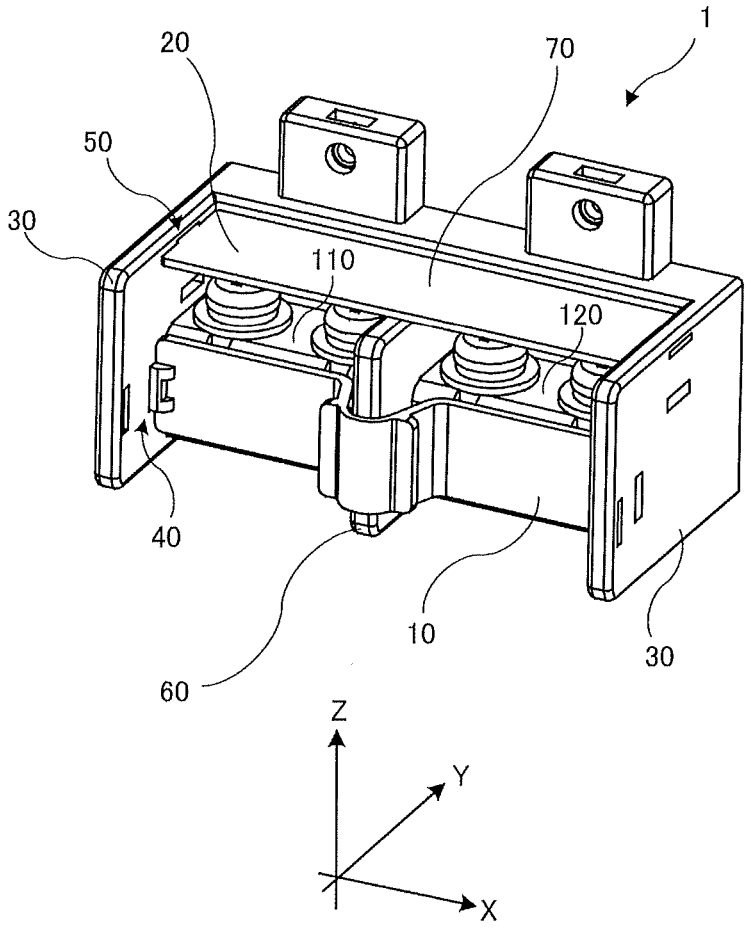
FIG. 1 is a perspective view of a terminal block according to an embodiment of the present invention.

An embodiment of the present invention will be described below with reference to the accompanying drawings. FIGS. 1 to 8 show an example of embodiment of the present invention. In the diagrams, portions denoted by the same reference numerals represent the same components. In the diagrams, some of the configurations are omitted as appropriate for simplification. Members may be exaggerated in size, shape, thickness, and the like if needed.

FIG. 1 shows a terminal block 1 according to the embodiment of the present invention. The terminal block 1 includes: a terminal block main body portion 70 that is made of an insulating material; a pair of side walls 30 that constitute part of the terminal block main body portion 70; a separator 60 that is erected between the pair of side walls 30 to be continuous with the terminal block main body portion 70; a first conductive plate 110 that is arranged between one of the side walls 30 and the separator 60; a second conductive plate 120 that is arranged between the other side wall 30 and the separator 60; a connection side terminal cover 20 that covers portions of the first and second conductive plates 110 and 120 to which wires are connected; and a non-connection side terminal cover 10 that covers portions of the first and second conductive plates 110 and 120 to which wires are not connected. The separator 60, which is made of an insulating material similar to that of the side walls 30, is interposed between the first conductive plate 110 and the second conductive plate 120. The side walls 30 are arranged on outer sides of the terminal block main body portion 70 in a width direction of the conductive plates to be described later. The separator 60 may be regarded as a kind of side wall.

Figure 2A:
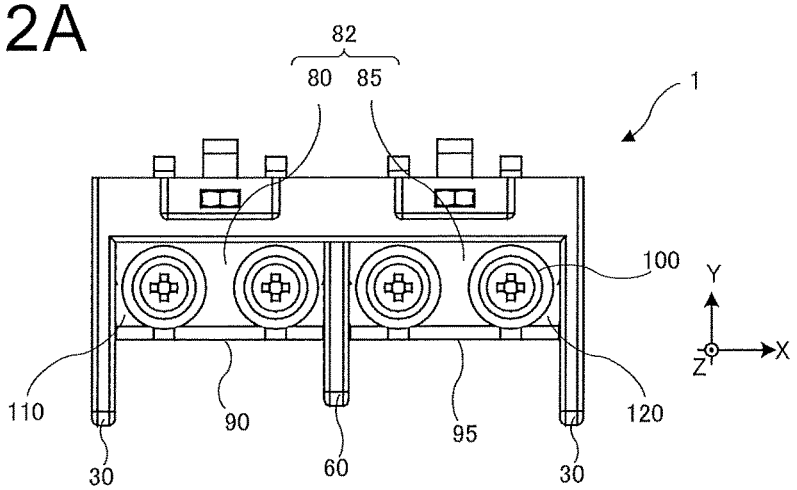
FIG. 2A is a top view of the terminal block.
Figure 2B:
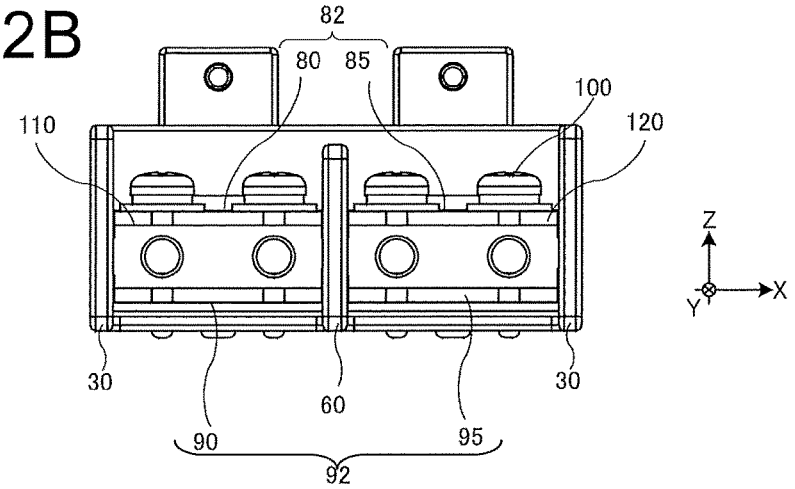
FIG. 2B is a front view of the terminal block.

The shape of the conductive plates of the terminal block 1 will be described in detail with reference to FIGS. 2A and 2B. In FIGS. 2A and 2B, screws for fixing crimp terminals can be fastened to all of eight terminal fastening portions in total. In fact, screws are fastened only to locations where crimp terminals are connected.

FIG. 2A shows a top view of the terminal block 1. FIG. 2B shows a front view of the terminal block 1. The terminal block 1 includes the first conductive plate 110 and the second conductive plate 120. The first conductive plate 110 includes a first-direction first connection portion 90 (see FIG. 2B) and a second-direction first connection portion 80 (see FIG. 2A). The first-direction first connection portion 90 can be connected with two wires and extends in a first direction (here, Z-axis direction). The second-direction first connection portion 80 is in electrical conduction with the first-direction first connection portion 90. The second-direction first connection portion 80 extends in a second direction (here, Y-axis direction) different from the first direction and can be connected with two wires. When seen in a side view, the second-direction first connection portion 80 and the first-direction first connection portion 90 are mutually perpendicularly and continuously formed in an L shape.

The second conductive plate 120 includes a first-direction second connection portion 95 (see FIG. 2B) and a second-direction second connection portion 85 (see FIG. 2A). The first-direction second connection portion 95 can be connected with two wires and extends in the first direction (here, Z-axis direction). The second-direction second connection portion 85 is in electrical conduction with the first-direction second connection portion 95. The second-direction second connection portion 85 extends in the second direction (here, Y-axis direction) different from the first direction and can be connected with two wires. The second-direction second connection portion 85 and the first-direction second connection portion 95 are substantially perpendicularly and continuously formed. When seen in a side view, the second- and first-direction second connection portions 85 and 95 are mutually perpendicularly and continuously formed in an L shape.

The first and second conductive plates 110 and 120 are arranged between the respective side walls 30 and the separator 60 which is formed in parallel with the side walls 30. The first and second conductive plates 110 and 120 are thus disposed in parallel in a width direction (here, X-axis direction) as separated by the separator 60.

The first direction and the second direction may be set in various angular relationships. However, as in the present embodiment, the first direction is desirably set to the Z-axis direction and the second direction the Y-axis direction so that the two directions are substantially orthogonal to each other.

The wires connected to the first conductive plate 110 and the second conductive plate 120 are fixed by using screws 100 which are fastened to screw holes (not shown) formed in the respective conductive plates. Specifically, two female screw holes (not shown) arranged in the width direction (X-axis direction) are formed in the first-direction first connection portion 90 of the first conductive plate 110. Screws 100 are threadedly engaged with the respective female screw holes in the second direction (Y-axis direction). Two female screw holes (not shown) arranged in the width direction (X-axis direction) are formed in the second-direction first connection portion 80 of the first conductive plate 110. Screws 100 are threadedly engaged with the respective female screw holes in the first direction (Z-axis direction). A total of four terminal fastening portions are thus formed on the first conductive plate 110.

Similarly, two female screw holes (not shown) arranged in the width direction (X-axis direction) are formed in the first-direction second connection portion 95 of the second conductive plate 120. Screws 100 are threadedly engaged with the respective female screw holes in the second direction (Y-axis direction). Two female screw holes (not shown) arranged in the width direction (X-axis direction) are formed in the second-direction second connection portion 85 of the second conductive plate 120. Screws 100 are threadedly engaged with the respective female screw holes in the first direction (Z-axis direction). A total of four terminal fastening portions are thus formed on the second conductive plate 120.

In the present embodiment, the connection portions 80, 85, 90, and 95 are described to include a plurality (in the present embodiment, two) of terminal fastening portions each. However, the present invention is not limited thereto. The connection portions 80, 85, 90, and 95 may include a single terminal fastening portion each.

Returning to FIG. 1, the terminal block 1 includes the non-connection side terminal cover 10 and the connection side terminal cover 20. The non-connection side terminal cover 10 covers the surface of the first-direction first connection portion 90 (see FIG. 2B) and the surface of the first-direction second connection portion 95 (see FIG. 2B). The connection side terminal cover 20 covers the second-direction first connection portion 80 and the second-direction second connection portion 85. The non-connection side terminal cover 10 and the connection side terminal cover 20 reduce the possibility that fingers accidentally touch the crimp terminal portion of a wire, the first conductive plate 110, or the second conductive plate 120. The non-connection side terminal cover 10 and the connection side terminal cover 20 are desirably made of an insulating material.

Next, detailed shapes and fixing modes of the non-connection side terminal cover 10 and the connection side terminal cover 20 will be described in detail. For convenience of description, each of the first-direction first connection portion 90 and the first-direction second connection portion 95 will be referred to as a first-direction connection portion 92. Both may be referred to collectively as a first-direction connection portion 92. Each of the second-direction first connection portion 80 and the second-direction second connection portion 85 will be referred to as a second-direction connection portion 82. Both may be referred to collectively as a second-direction connection portion 82.

As shown in FIG. 1, the side walls 30 include a first engagement portion 40 and a second engagement portion 50 each. The first engagement portions 40 hold the non-connection side terminal cover 10 in a position in which the non-connection side terminal cover 10 covers the first-direction first connection portion 92 (see FIGS. 2A and 2B). The second engagement portions 50 hold the connection side terminal cover 20 in a position in which the connection side terminal cover 20 covers the second-direction connection portion 82 (see FIGS. 2A and 2B).

Figure 2C:
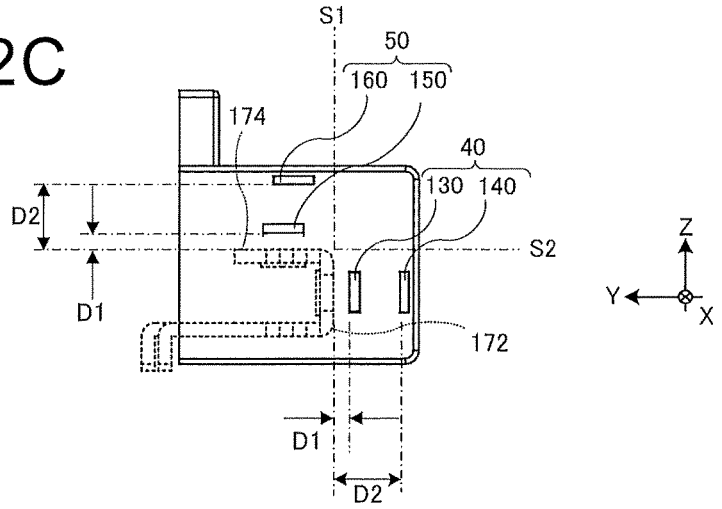
FIG. 2C is a side view of only a side wall of the terminal block as seen from a first conductive plate side.

FIG. 2C shows only the side wall 30 lying on the right in FIGS. 2A and 2B, as seen from a left side surface which is an inner side in the width direction (from the first conductive plate 110 side). Since the side wall 30 lying on the left has a symmetrical structure, a description thereof will be omitted.

The side wall 30 includes the first engagement portion 40 and the second engagement portion 50. The first engagement portion 40 includes a first side non-connection engagement portion 130 and a first side connection engagement portion 140. The second engagement portion 50 includes a second side non-connection engagement portion 150 and a second side connection engagement portion 160. The engagement portions 130, 140, 150, and 160 are formed as recessed fitting holes.

The first side non-connection engagement portion 130 engages with the non-connection side terminal cover 10 when the non-connection side terminal cover 10 covers the first-direction connection portion 92. The first side connection engagement portion 140 is engaged with the connection side terminal cover 20 when the connection side terminal cover 20 covers the first-direction connection portion 92. Similarly, the second side non-connection engagement portion 150 is engaged with the non-connection side terminal cover 10 when the non-connection side terminal cover 10 covers the second-direction connection portion 82. The second side connection engagement portion 160 is engaged with the connection side terminal cover 20 when the connection side terminal cover 20 covers the second-direction connection portion 82.

A surface of the first-direction connection portion 92 on which a wire is placed will be defined as a first wiring placement surface 172. A surface of the second-direction connection portion 82 on which a wire is placed will be defined as a second wiring placement surface 174. A distance between the first wiring placement surface 172 and the first side non-connection engagement portion 130 and a distance between the second wiring placement surface 174 and the second side non-connection engagement portion 150 are substantially equal to each other, namely, D1. A distance between the first wiring placement surface 172 and the first side connection engagement portion 140 and a distance between the second wiring placement surface 174 and the second side connection engagement portion 160 are substantially equal to each other, namely, D2. D2 is greater than D1. In other words, the distance D2 between the first wiring placement surface 172 and the first side connection engagement portion 140 is greater than the distance D1 between the first wiring placement surface 172 and the first side non-connection engagement portion 130. Similarly, the distance D2 between the second wiring placement surface 174 and the second side connection engagement portion 160 is greater than the distance D1 between the second wiring placement surface 174 and the second side non-connection engagement portion 150.

As can also be seen from FIG. 1, the distance D2 from the connection side terminal cover 20 to the first wiring placement surface 172 and the second wiring placement surface 174 on the connection side is greater than the distance D1 from the non-connection side terminal cover 10 to the first wiring placement surface 172 and the second wiring placement surface 174 on the non-connection side. The distance D2 is a distance such that the heads of the screws 100 do not interfere with the connection side terminal cover 20 when crimp terminals formed at the ends of load lines are connected to the first and second conductive plates 110 and 120 by the screws 100. Now, suppose that the non-connection side terminal cover 10 is engaged with the first or second side non-connection engagement portion 130 or 150 to cover the first or second wiring placement surface 172 or 174 on the non-connection side with the non-connection side terminal cover 10. The resulting distance D1 is so narrow that fingers or conductive parts will not enter the gaps between the first or second wiring placement surface 172 or 174 and the non-connection side terminal cover 10.

The first side non-connection engagement portion 130 and the second side non-connection engagement portion 150 have substantially the same shapes. That is, according to the present embodiment, the fitting holes of the first side non-connection engagement portion 130 and the second side non-connection engagement portion 150 have substantially the same outer shapes and dimensions. The first-direction connection portion 92 and the second-direction connection portion 82 can thus use the non-connection side terminal cover 10 of common shape. The first side connection engagement portion 140 and the second side connection engagement portion 160 have substantially the same shapes. That is, according to the present embodiment, the fitting holes of the first side connection engagement portion 140 and the second side connection engagement portion 160 have substantially the same outer shapes and dimensions. The first-direction connection portion 92 and the second-direction connection portion 82 can thus use the connection side terminal cover 20 of common shape.

On the other hand, the common shape of the first side non-connection engagement portion 130 and the second side non-connection engagement portion 150 and the common shape of the first side connection engagement portion 140 and the second side connection engagement portion 160 are different from each other. The engagement portions to be engaged with the non-connection side terminal cover 10 thus have a shape different from that of the engagement portions to be engaged with the connection side terminal cover 20. This eliminates the possibility that the non-connection side terminal cover 10 is accidentally engaged with the first side connection engagement portion 140 or the second side connection engagement portion 160. A gap that fingers can enter is therefore less likely to occur, and there is provided an effect of improving safety.

Figure 3A:
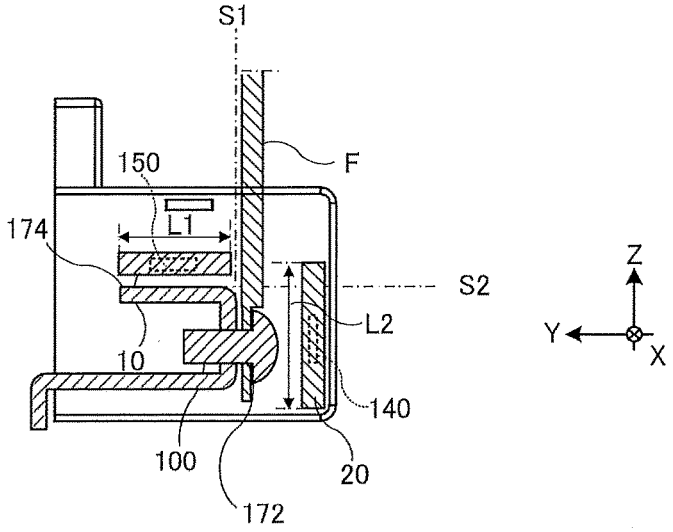
FIGS. 3A and 3B are sectional side views showing states in which a non-connection side terminal cover and a connection side terminal cover are installed on the terminal block.
Figure 3B:
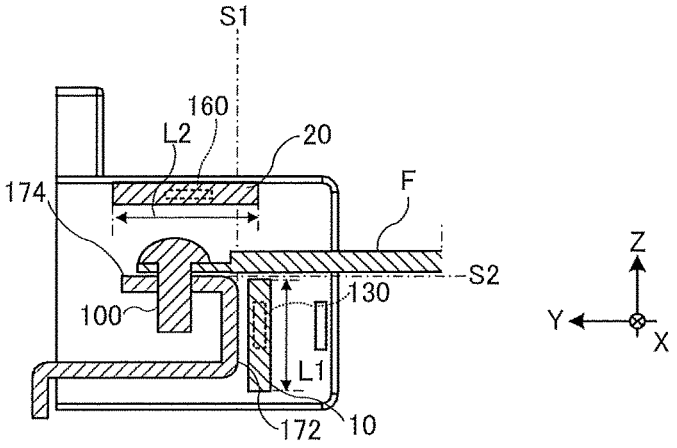

As shown in FIGS. 3A and 3B, the non-connection side terminal cover 10 is set to a dimension L1 not interfering with a virtually extended plane S1 or S2 of the wiring placement surface 172 or 174 to which a wire or wires is/are connected (the wiring placement surface 172 or 174 not covered with the non-connection side terminal cover 10). Similarly, the connection side terminal cover 20 is set to a dimension L2 interfering with the virtual extended plane S1 or S2 of the wiring placement surface 172 or 174 to which no terminal is connected (the wiring placement surface 172 or 174 not covered with the connection side terminal cover 20).

Specifically, for example, as shown in FIG. 3A, suppose that the non-connection side terminal cover 10 is engaged with the second side non-connection engagement portion 150. The dimension L1 of the non-connection side terminal cover 10 in the Y-axis direction is set not to interfere with the virtual plane S1 of the first wiring placement surface 172 to which a load line F is connected. This can reduce the possibility that the non-connection side terminal cover 10 damages the cladding of the load line F.

Suppose that the connection side terminal cover 20 is engaged with the first side connection engagement 140. The dimension L2 of the connection side terminal cover 20 in the Z direction is set to interfere with the virtual surface S2 of the second wiring placement surface 174 to which no load line F is connected. The connection side terminal cover 20 provides a structure to cover even a small gap between the non-connection side terminal cover 10 and the second wiring placement surface 174 on the non-connection side, and reduces the possibility that fingers and conductive parts accidentally touch the non-connection side connection portions. Aside from the connection of load lines F having crimp terminals, a conductor bar (bus bar) having connection holes may be used to connect a plurality of terminal blocks 1. In such a case, the bus bar is desirably covered with an insulator in areas other than where electrically connected, so that fingers touching the bus bar will not get an electric shock.

For example, as shown in FIG. 3B, suppose that the non-connection side terminal cover 10 is engaged with the first side non-connection engagement portion 130. The dimension L1 of the non-connection side terminal cover 10 in the Z-axis direction is set not to interfere with the virtual plane S2 of the second wiring placement surface 174 to which a load line F is connected. This can reduce the possibility that the non-connection side terminal cover 10 damages the cladding of the load line F.

Suppose that the connection side terminal cover 20 is engaged with the second side connection engagement portion 160. The dimension L2 of the connection side terminal cover 20 in the Y-axis direction is set to interfere with the virtual plane S1 of the first wiring placement surface 172 to which no load line F is connected. The connection side terminal cover 20 provides a structure to cover even a small gap between the non-connection side terminal cover 10 and the first wiring placement surface 172 on the non-connection side, and reduces the possibility that fingers and conductive parts accidentally touch the non-connection side connection portions.

Such structures will be described from a different perspective. The dimension L1 in the Y-axis direction or Z-axis direction which is a planar direction of the non-connection side terminal cover 10 in an installed state is smaller than the dimension L2 in the Y-axis direction or Z-axis direction which is a planar direction of the connection side terminal cover 20 in an installed state.

Figure 4A:
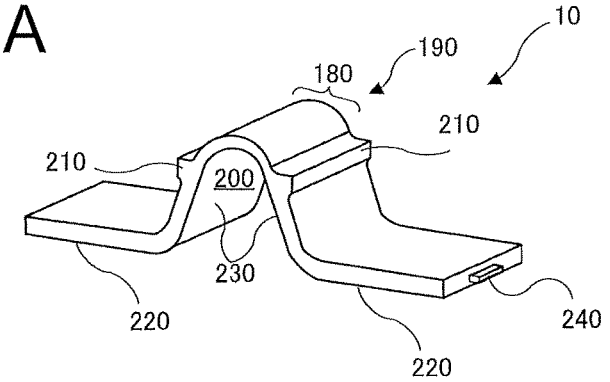
FIG. 4A is a perspective view.
Figure 4B:
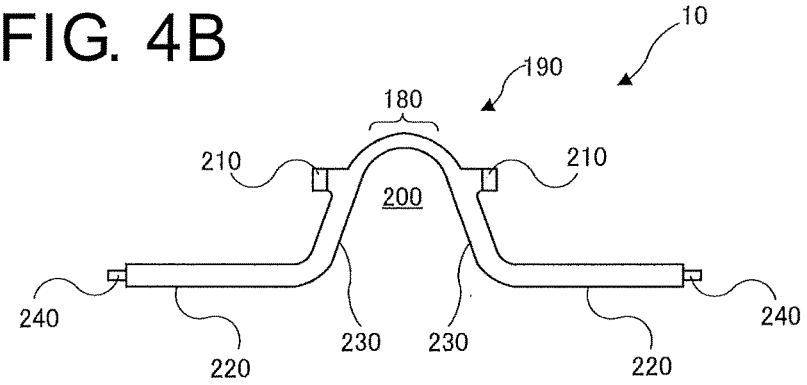
FIG. 4B is a front view.

Next, the structure of the non-connection side terminal cover 10 will be described in detail with reference to FIGS. 4A to 4C. The non-connection side terminal cover 10 is a band-like plate with its longitudinal direction corresponding to the width direction (X-axis direction in FIG. 1) of the first and second conductive plates 110 and 120. A curved portion 190 locally curved in a direction away from the first and second conductive plates 110 and 120 is formed in the longitudinal midsection (here, center) of the band-like plate.

The non-connection side terminal cover 10 further includes proximity surfaces 220 and receding surfaces 230 on a side opposed to the connection portions (wiring placement surfaces). The proximity surfaces 220 are arranged close to or in contact with the surface of the first-direction connection portion 92 or the second-direction connection portion 82. The receding surfaces 230 are surfaces continuous with the proximity surfaces 220 in the width direction of the conductive plates (X-axis direction in FIG. 1). The receding surfaces 230 recede from the first-direction connection portion 92 or the second-direction connection portion 82 along the side wall 30 or the separator 60. In the present embodiment, a pair of receding surfaces 230 is formed in an opposed state in the longitudinal midsection of the non-connection side terminal cover 10. A recessed portion 200 is formed by the pair of receding surfaces 230, 230. The recessed portion 200 constitutes an inner surface of the curved portion 190. The recessed portion 200 is formed to circumvent a part of the separator 60 to prevent interference between the non-connection side terminal cover 10 and the separator 60.

Finger hook protrusions 210 for fingers to be engaged with are formed on an outer surface of the curved portion 190 of the non-connection side terminal cover 10. The user can hold the non-connection side terminal cover 10 with fingers engaged with the protrusions 210. This reduces the possibility of accidentally touching the terminals in attaching or detaching the non-connection side terminal cover 10.

The curved portion 190 includes an elastically-deformable bending portion 180 in an area where the curvature is small, namely, near the protruding end of the curved portion 190 or near the bottom surface of the recessed portion 200. When the curved portion 190 is pinched between fingers, the bending portion 180 can be elastically deformed to bring the pair of receding surfaces 230 close to each other.

Figure 4C:
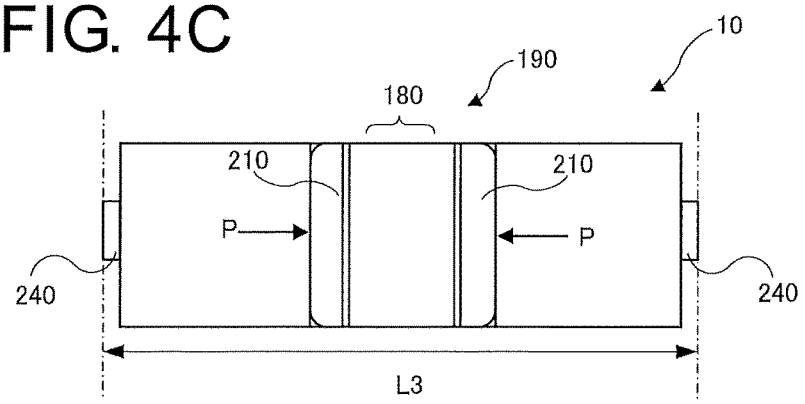
FIG. 4C is a top view of the non-connection side terminal cover.

As shown in FIG. 4C, suppose that the protrusions 210 are pinched between fingers and the curved portion 190 of the non-connection side terminal cover 10 is pressed in the directions of the arrows P. This elastically deforms the bending portion 180 to reduce a length L3 of the non-connection side terminal cover 10 in the longitudinal direction of the band (width direction of the first conductive plate 110 and the second conductive plate 120).

Fixing portions 240 capable of being engaged with the first side non-connection engagement portions 130 and the second side non-connection engagement portions 150 of the terminal block 1 are arranged at both longitudinal ends of the non-connection side terminal cover 10. The fixing portions 240 are protrusions partially extended from the proximity surfaces 220 in the longitudinal direction of the band (width direction of the conductive plates 110 and 120). The first side non-connection engagement portions 130 and the second side non-connection engagement portions 150 serve as fitting holes to be engaged with the fixing portions 240.

With such a structure, the curved portion 190 of the non-connection side terminal cover 10 can be pinched and deformed between fingers to contract and expand the longitudinal length L3 of the non-connection side terminal cover 10. The protrusions of the fixing portions 240 can be thereby inserted into and removed from the fitting holes of the first side non-connection engagement portions 130 and the second side non-connection engagement portions 150. The non-connection side terminal cover 10 can thus be easily detached from and attached to the first side non-connection engagement portions 130 and the second side non-connection engagement portions 150.

Figure 5A:
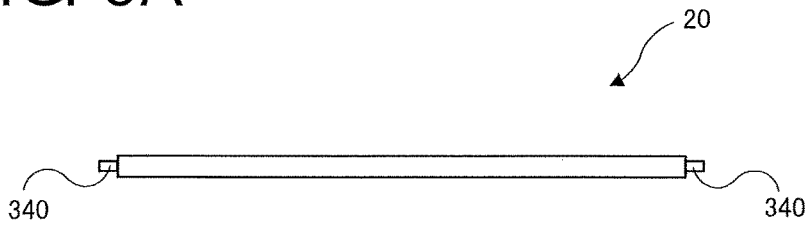
FIG. 5A is a front view and FIG. 5B is a top view of the connection side terminal cover.
Figure 5B:
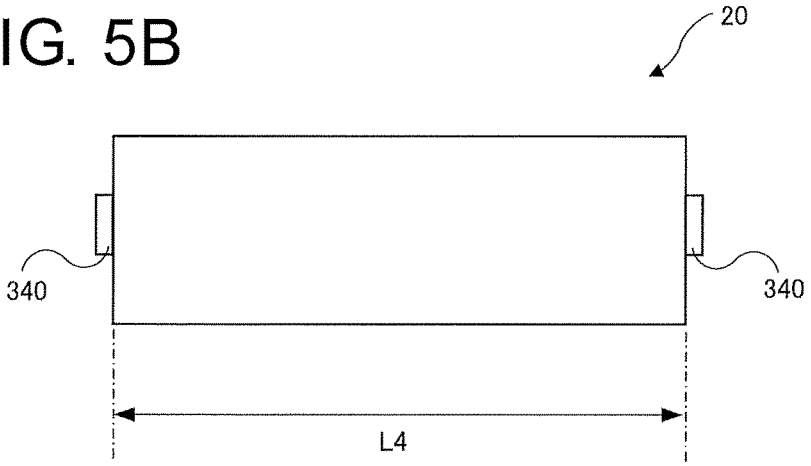

Next, a structure of the connection side terminal cover 20 will be described in detail with reference to FIGS. 5A and 5B. The connection side terminal cover 20 is a band-like plate with its longitudinal direction corresponding to the width direction of the first and second conductive plates 110 and 120 (X-axis direction in FIG. 1). Unlike the non-connection side terminal cover 10, the connection side terminal cover 20 does not include a curved portion in the middle (here, center). It will be understood that a curved portion for pinching may be formed.

Fixing portions 340 capable of being engaged with the first side connection engagement portions 140 and the second side connection engagement portions 160 of the terminal block 1 are formed at both longitudinal ends of the connection side terminal cover 20. The fixing portions 340 are protrusions partially extended from the longitudinal end edges of the band-like plate in the longitudinal direction of the band (width direction of the conductive plates 110 and 120). The first side connection engagement portions 140 and the second side connection engagement portions 160 serve as fitting holes for the fixing portions 340 to be engaged with.

With such a structure, the entire connection side terminal cover 20 is bent to contract and expand the longitudinal length L4. The protrusions of the fixing portions 340 are thereby inserted into and removed from the fitting holes of the first side connection engagement portions 140 and the second side connection engagement portions 160. Without a curved portion on the connection side terminal cover 20, the long sides of the connection side terminal cover 20 can be pinched to bend the entire connection side terminal cover 20 so that the longitudinal length L4 contracts or expands. The connection side terminal cover 20 can thus be easily detached from and attached to the first side connection engagement portions 140 and the second side connection engagement portions 160.

The fixed portions 340 have a shape different from that of the protrusions 240 of the non-connection side terminal cover 10. The protrusions 240 of the non-connection side terminal cover 10 are unable to be fit into the first side connection engagement portions 140 or the second side connection engagement portions 160.

Figure 6A:
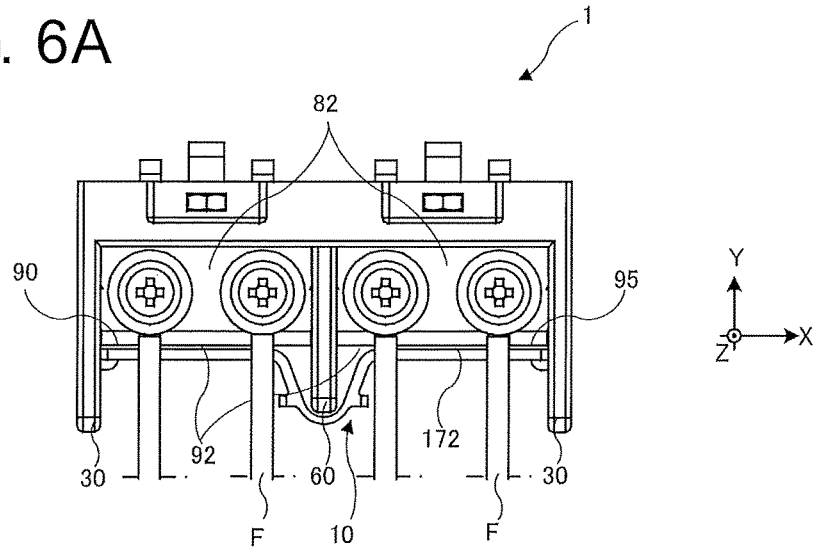
FIG. 6A is a top view of the terminal block in which the non-connection side terminal cover is attached to a first-direction connection portion.
Figure 6B:
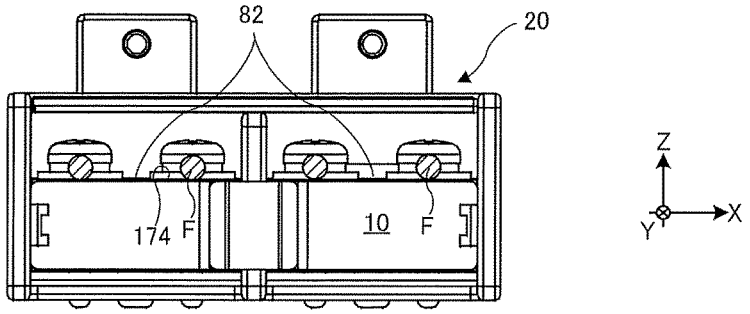
FIG. 6B is a front view of the terminal block in which the non-connection side terminal cover is attached to the first-direction connection portion and the connection side terminal cover is attached to a second-direction connection portion.
Figure 6C:
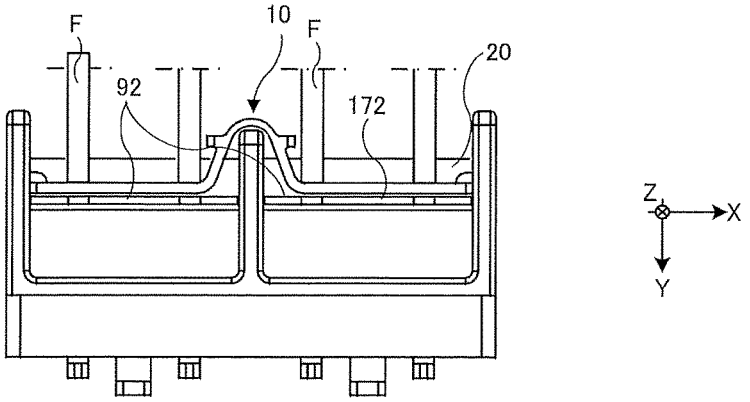
FIG. 6C is a bottom view of the terminal block in which the non-connection side terminal cover is attached to the first-direction connection portion.

FIGS. 6A to 6C show the terminal block 1 in which the non-connection side terminal cover 10 is attached to the first-direction connection portions 92, and the connection side terminal cover 20 is attached to the second-direction connection portions 82. In FIG. 6A, the connection side terminal cover 20 for covering the second-direction connection portion 82 is omitted.

As shown in FIG. 6A, the non-connection side terminal cover 10 covers the first-direction connection portion 92 in proximity to the first-direction connection portion 92. This can reduce the possibility that fingers accidentally touch the first-direction connection portion 92.

As shown in FIG. 6B, the connection side terminal cover 20 covers the second-direction connection portion 82 at a distance from the screws 100 of the second-direction connection portion 82. The dimensions of the non-connection side terminal cover 10 are set so that the second wiring placement surface 174 of the second-direction connection portion 82 is not covered.

As shown in FIG. 6C, the dimensions of the connection side terminal cover 20 are set so that the first wiring placement surface 172 of the first-direction connection portion 92 is covered. This can consequently improve safety since the crimp terminals at the ends of the load lines connected to the second-direction connection portion 82 can be covered.

As described above, the terminal block 1 of the present embodiment has the structure that the curved portion 190 is formed in the longitudinal midsection of the non-connection side terminal cover 10, and the curved portion 190 circumvents the separator 60 serving as a part of the side walls. However, the present invention is not limited to such an example. The separator 60 may be engaged with the curved portion 190.

Figure 7A:
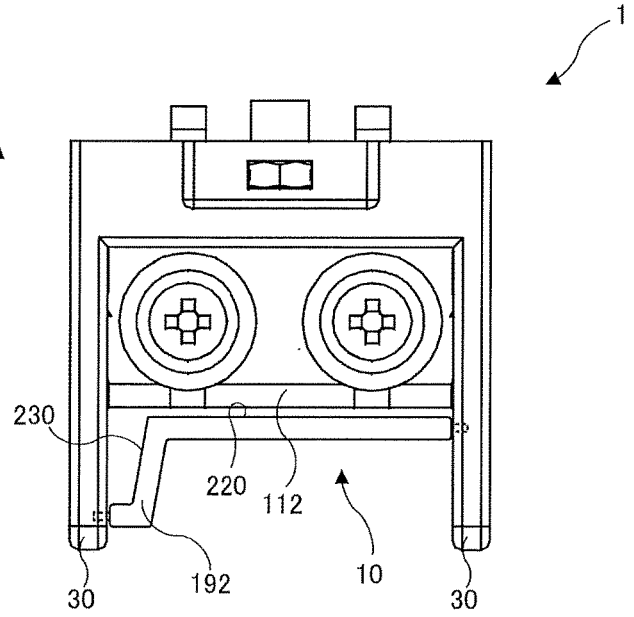
FIGS. 7A and 7B are top views showing other configuration examples of the terminal block according to the present embodiment.

For example, as shown in FIG. 7A, a terminal block 1 may include only one conductive plate 112. In such a case, a curved portion or portions 192 is formed on one or both longitudinal ends of the non-connection side terminal cover 10, so that the inner surface of the curved portion 192 forms a receding surface 230. A gap is preferably formed between the receding surface 230 and the side wall 30. The operator can easily detach and attach the non-connection side terminal cover 10 from/to the side walls 30 by pinching the curved portion 192 between fingertips and deforming the non-connection side terminal cover 10 by pressure of the fingertips.

Figure 7B:
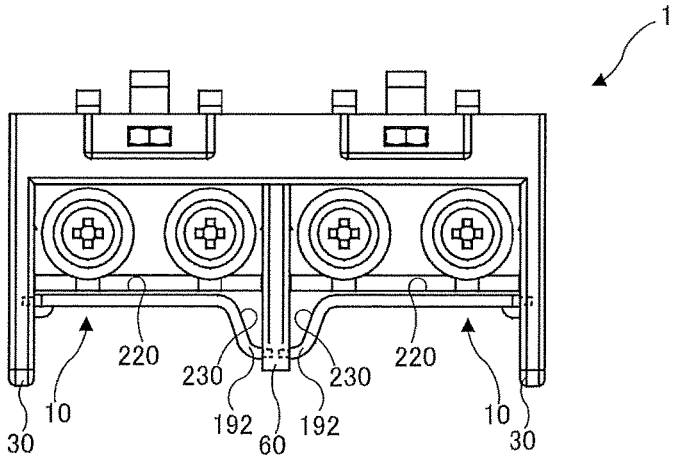

As shown in FIG. 7B, if a terminal block 1 includes a plurality of conductive plates 110 and 120, non-connection side terminal covers 10, 10 may be independently provided for the respective conductive plates 110 and 120. In such a case, the non-connection side terminal covers 10, 10 are held by the respective side walls 30 and the separator 60. A curved portion 192 is formed on one or both longitudinal ends of each non-connection side terminal cover 10, 10. The curved portion 192 forms a receding surface 230. If a gap is formed between the receding surface 230 and the side wall 30, the operator can easily detach and attach the non-connection side terminal cover 10 from/to the side wall 30 and the separator 60 by pinching the curved portion 192 between fingertips and bending the non-connection side terminal cover 10 by pressure of the fingertips.

Figure 8A:
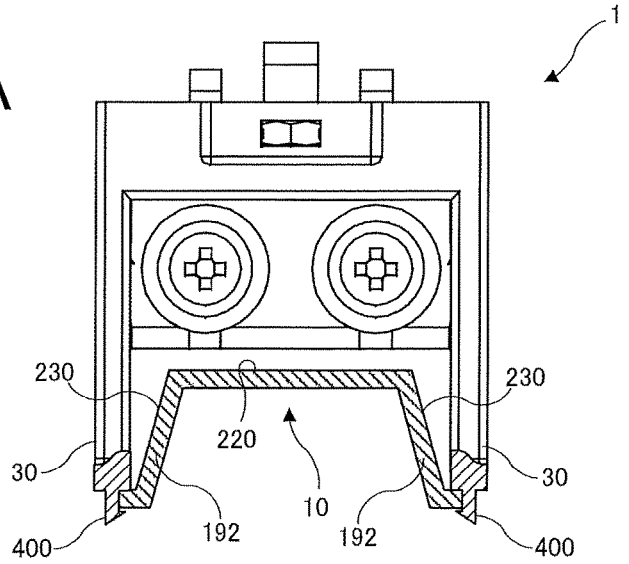
FIG. 8A is a top view and FIG. 8B is a front view showing another configuration example of the terminal block of the present embodiment.
Figure 8B:
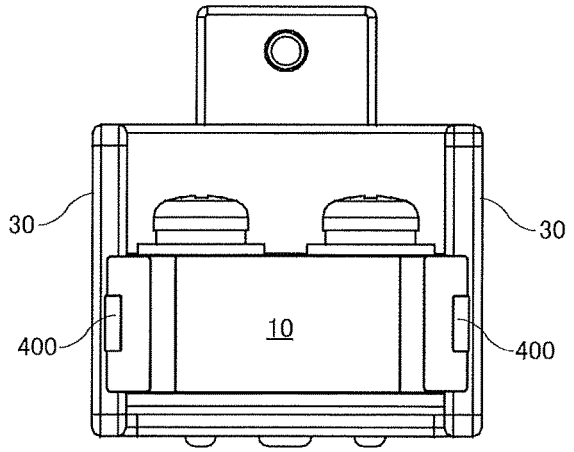
Figure 9A:
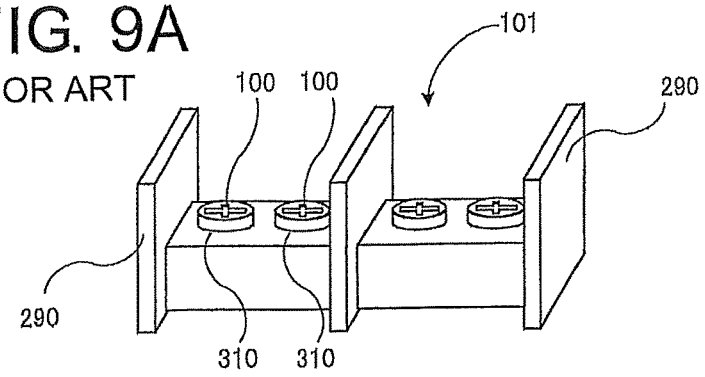
FIG. 9A PRIOR ART
FIG. 9A is an explanatory diagram for describing a conventional terminal block.
Figure 9B:
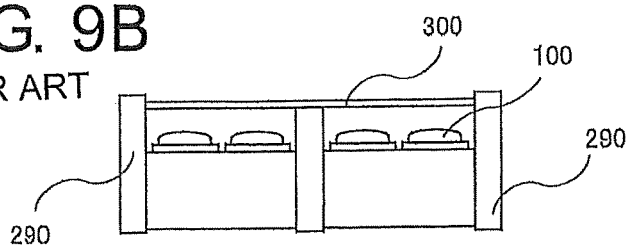
FIG. 9B PRIOR ART
FIG. 9B is a front view of the conventional terminal block.
Figure 9C:
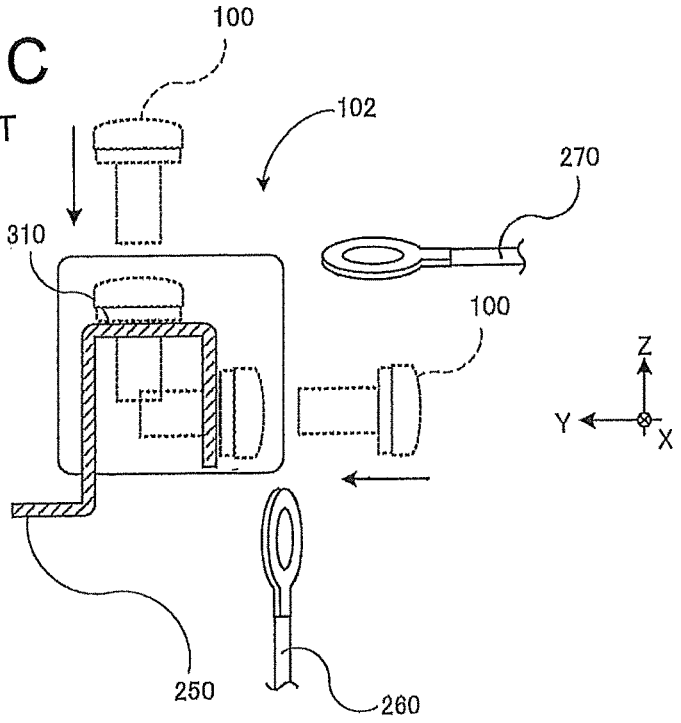
FIG. 9C PRIOR ART
FIG. 9C is a sectional side view of a conventional terminal block to which load lines can be connected in a plurality of directions.

In the foregoing embodiment, the engagement portions for holding the non-connection side terminal cover 10 and the connection side terminal cover 20 are described to be formed on the inner surfaces of the side walls 30. However, the present invention is not limited thereto. For example, as shown in FIGS. 8A and 8B, engagement portions 400 may be formed on the end faces of the side walls 30 and engaged with the non-connection side terminal cover 10 and the connection side terminal cover 20. In such a case, engagement recesses or protrusions are preferably formed in/on the end faces of the side walls 30 so that the longitudinal ends of the non-connection side terminal cover 10 or the connection side terminal cover 20 are engaged with the engaging recesses or protrusions.

In the foregoing embodiment, each conductive plate is described to include two connection portions in respective different directions (angles). However, the present invention is not limited thereto. For example, each conductive plate may include three connection portions which are arranged to have a U-shaped cross section. In such a case, the three connection portions can be covered with one connection side terminal cover and two non-connection side terminal covers.

It will be understood that the terminal block according to the present invention is not limited to the foregoing embodiment, and various modifications may be made without departing from the gist of the present invention.

What is claimed is:

1. A terminal block comprising:

a conductive plate including a first-direction connection portion configured to extend in a first direction and to be capable of being connected with at least one wire, and a second-direction connection portion configured to be in electrical conduction with the first-direction connection portion, to extend in a second direction different from the first direction, and to be capable of being connected with at least one wire;

a terminal block main body portion including a side wall arranged on an outer side of the conductive plate in a width direction;

a terminal cover configured to cover a surface of any one of the first-direction connection portion and the second-direction connection portion, the terminal cover including a proximity surface that comes close to or in contact with a surface of the first-direction connection portion or the second-direction connection portion, and a receding surface that is continuously formed from the proximity surface and recedes from the first-direction connection portion or the second-direction connection portion;

a first engagement portion configured to be formed on the terminal block main body portion and to hold the terminal cover in a position in which the terminal cover covers the first-direction connection portion; and a second engagement portion configured to be formed on the terminal block main body portion and to hold the terminal cover in a positon in which the terminal cover covers the second-direction connection portion.

2. The terminal block according to claim 1, wherein the conductive plate comprises a plurality of conductive plates disposed in parallel in the width direction, the side wall is interposed between the plurality of conductive plates so that the side wall serves as a separator, and in the terminal cover, the receding surface comprises a pair of receding surfaces forming a recessed portion, the recessed portion being formed to circumvent a part of the separator.

3. The terminal block according to claim 1, wherein the terminal cover includes a connection side terminal cover configured to cover any one of the first-direction connection portion and the second-direction connection portion to which a wire is connected, and a non-connection side terminal cover configured to cover the other of the first-direction connection portion and the second-direction connection portion to which no wire is connected, and the non-connection side terminal cover is set to a dimension not interfering with a virtually extended plane of a wiring placement surface of the one connection portion.

4. The terminal block according to claim 1, wherein the conductive plate comprises a plurality of conductive plates disposed in parallel in the width direction, the side wall is interposed between the plurality of conductive plates so that the side wall serves as a separator, and the terminal cover includes a curved portion curved to circumvent the separator.

5. The terminal block according to claim 4, wherein the curved portion includes an elastically-deformable bending portion.

6. The terminal block according to claim 4, wherein the curved portion includes a protrusion configured to be engageable with a finger.

7. The terminal block according to claim 6, wherein the curved portion includes an elastically-deformable bending portion.

8. The terminal block according to claim 1, wherein the terminal cover includes a connection side terminal cover configured to cover any one of the first-direction connection portion and the second-direction connection portion to which a wire is connected, and a non-connection side terminal cover configured to cover the other of the first-direction connection portion and the second-direction connection portion to which no wire is connected, and a distance between the connection side terminal cover and the one connection portion is greater than that between the non-connection side terminal cover and the other connection portion.

9. The terminal block according to claim 8, wherein the first engagement portion includes a first side non-connection engagement portion for the non-connection side terminal cover to be engaged with and a first side connection engagement portion for the connection side terminal cover to be engaged with, the second engagement portion includes a second side non-connection engagement portion for the non-connection side terminal cover to be engaged with and a second side connection engagement portion for the connection side terminal cover to be engaged with, the first side non-connection engagement portion and the second side non-connection engagement portion have substantially the same shapes, and the first side connection engagement portion and the second side connection engagement portion have substantially the same shapes.

10. The terminal block according to claim 9, wherein a common shape of the first side non-connection engagement portion and the second side non-connection engagement portion is different from a common shape of the first side connection engagement portion and the second side connection engagement portion.

11. A terminal block comprising:

a conductive plate including a first-direction connection portion configured to extend in a first direction and to be capable of being connected with at least one wire, and a second-direction connection portion configured to be in electrical conduction with the first-direction connection portion, to extend in a second direction different from the first direction, and to be capable of being connected with at least one wire;

a terminal block main body portion including a side wall arranged on an outer side of the conductive plate in a width direction;

a terminal cover configured to cover a surface of any one of the first-direction connection portion and the second-direction connection portion;

a first engagement portion configured to be formed on the terminal block main body portion and to hold the terminal cover in a position in which the terminal cover covers the first-direction connection portion; and a second engagement portion configured to be formed on the terminal block main body portion and to hold the terminal cover in a position in which the terminal cover covers the second-direction connection portion;

wherein the conductive plate comprises a plurality of conductive plates disposed in parallel in the width direction, the side wall is interposed between the plurality of conductive plates so that the side wall serves as a separator, and the terminal cover includes a curved portion curved to circumvent the separator.

12. The terminal block according to claim 11, wherein the curved portion includes an elastically-deformable bending portion.

13. The terminal block according to claim 11, wherein a gap is formed between the curved portion and the separator, and the gap increases toward the first-direction connection portion or the second-direction connection portion.

14. The terminal block according to claim 11, wherein the curved portion includes a protrusion configured to be engageable with a finger.

15. The terminal block according to claim 14, wherein the curved portion includes an elastically-deformable bending portion.

16. The terminal block according to claim 11, wherein the terminal cover includes a connection side terminal cover configured to cover any one of the first-direction connection portion and the second-direction connection portion to which a wire is connected, and a non-connection side terminal cover configured to cover the other of the first-direction connection portion and the second-direction connection portion to which no wire is connected, and the non-connection side terminal cover is set to a dimension not interfering with a virtually extended plane of a wiring placement surface of the one connection portion.

17. The terminal block according to claim 16, wherein the connection side terminal cover is set to a dimension interfering with a virtually extended plane of a wiring placement surface of the other connection portion.

18. The terminal block according to claim 11, wherein the terminal cover includes a connection side terminal cover configured to cover any one of the first-direction connection portion and the second-direction connection portion to which a wire is connected, and a non-connection side terminal cover configured to cover the other of the first-direction connection portion and the second-direction connection portion to which no wire is connected, and a distance between the connection side terminal cover and the one connection portion is greater than that between the non-connection side terminal cover and the other connection portion.

19. The terminal block according to claim 18, wherein the first engagement portion includes a first side non-connection engagement portion for the non-connection side terminal cover to be engaged with and a first side connection engagement portion for the connection side terminal cover to be engaged with, the second engagement portion includes a second side non-connection engagement portion for the non-connection side terminal cover to be engaged with and a second side connection engagement portion for the connection side terminal cover to be engaged with, the first side non-connection engagement portion and the second side non-connection engagement portion have substantially the same shapes, and the first side connection engagement portion and the second side connection engagement portion have substantially the same shapes.

20. The terminal block according to claim 19, wherein a common shape of the first side non-connection engagement portion and the second side non-connection engagement portion is different from a common shape of the first side connection engagement portion and the second side connection engagement portion.

* * * * *